United States Patent [19]

Trenam

[11] 3,944,871

[45] Mar. 16, 1976

[54] SELF-OPTIMIZING RF SIGNAL DETECTION AND PANORAMIC DISPLAY APPARATUS

[75] Inventor: Richard S. Trenam, Adelaide, Australia

[73] Assignee: The United States of America as represented by the Secretary of the Navy, Washington, D.C.

[22] Filed: Aug. 14, 1970

[21] Appl. No.: 70,610

[52] U.S. Cl. ..... 315/30; 324/77 CS; 324/121 R; 343/5 SA

[51] Int. Cl.[2] ..... H01J 29/52

[58] Field of Search ..... 343/5 SA; 324/77 D, 77 G, 324/77 S, 79 R, 79 D; 315/30

[56] References Cited

UNITED STATES PATENTS

| | | | |
|---|---|---|---|
| 2,638,561 | 5/1953 | Sziklai | 315/5.25 |
| 2,959,706 | 11/1960 | Cutler | 315/30 |
| 3,440,470 | 4/1969 | Decker | 315/10 |
| 3,794,878 | 2/1974 | Sickafus | 315/30 |

*Primary Examiner*—Maynard R. Wilbur
*Assistant Examiner*—G. E. Montone
*Attorney, Agent, or Firm*—R. S. Sciascia; G. J. Rubens

[57] ABSTRACT

Apparatus for detecting any signal occurring within a wide bandwidth and displaying it with a signal-to-noise performance substantially equal to that of a receiver of optimum bandwidth for that signal. The apparatus essentially comprises a special purpose cathode ray tube that functions as a plurality of different detectors that can self-optimize to detect any signal within a wide bandwidth by means of the interactions between the received signals and an electron beam having a wide range of electron velocities and traveling in a zig-zag path in the cathode ray tube.

1 Claim, 2 Drawing Figures

INVENTOR.
RICHARD S. TRENAM
BY
George J. Rubens

SELF-OPTIMIZING RF SIGNAL DETECTION AND PANORAMIC DISPLAY APPARATUS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Currently, requirements for self-optimizing detection apparatus that can optimize automatically and simultaneously for all signal bandwidths over a wide range are met by various techniques that are characterized by inherent disadvantages. In one technique the requirments are met by using a plurality or receivers simultaneously; however this technique is relatively expensive because of the extra equipment and additional personnel that are required. Furthermore this technique does not provide 100% coverage and transmitters operating in short bursts can be mixed by a receiver carrying out a search by sweeping methods. Also each of the plurality of receivers is optimized for only a particular bandwidth of signal. Unknown, complex signals may be so distorted by reception in a receiver having incorrect parameters that it becomes difficult to determine the true nature of the signals.

SUMMARY OF THE INVENTION

Self-optimizing apparatus for detecting and displaying panoramically any RF signal occurring within a selectively predetermined wide bandwidth are disclosed. The signal detected is displayed with a signal-to-noise ratio substantially equal to that of a receiver of optimum bandwidth for that particular RF signal. The essence of the invention comprises a special purpose cathode ray tube (CRT) in which an electron beam having a wide range of electron velocities, i.e., a white velocity spectrum, is deflected in a zig-zag manner through a region of the CRT whereby the beam has multiple interactions with the RF signal being detected and which is being carried by a pair of parallel, spaced electrodes disposed in the CRT. By making the cyclic period of the zig-zag substantially equal to the cyclic period of the RF signal, the effect of the RF signal on the electron beam is integrated over successive interactions. The resulting deflection of the electron beam thus constitutes the detecting mechanism of the device whereby detection behavior is substantially equivalent to linear detection by a zero-beat mixer. Different paths of the electron beam interact with different phases of the RF signal so that the complete electron beam essentially comprises a complete family of zero-beat detectors capable of detecting all possible phases of the received RF signal whereby the output electron beam thus has a spread between positive and negative limits representing detections of all possible phases of the RF signal. The novel device can be utilized in any situation requiring a self-optimizing receiver such as in electronic intelligence searching for new and hitherto unknown signals or as a receiver for an adaptive radar where the transmissions are continually varied to investigate various targets.

STATEMENT OF THE OBJECTS OF THE INVENTION

It is a primary object of the present invention to provide self-optimizing detection and panoramic display apparatus that can detect any signal occurring within a wide bandwidth and display it with a signal-to-noise ratio substantially equal to that of a receiver having optimum bandwidth for that particular signal.

Other objects, advantages and novel features of the invention will become apparent from the following detailed description of the invention when considered in conjunction with the accompanying drawings wherein:

DESCRIPTION OF THE PREFERRED EMBODIMENT

Figure 1:
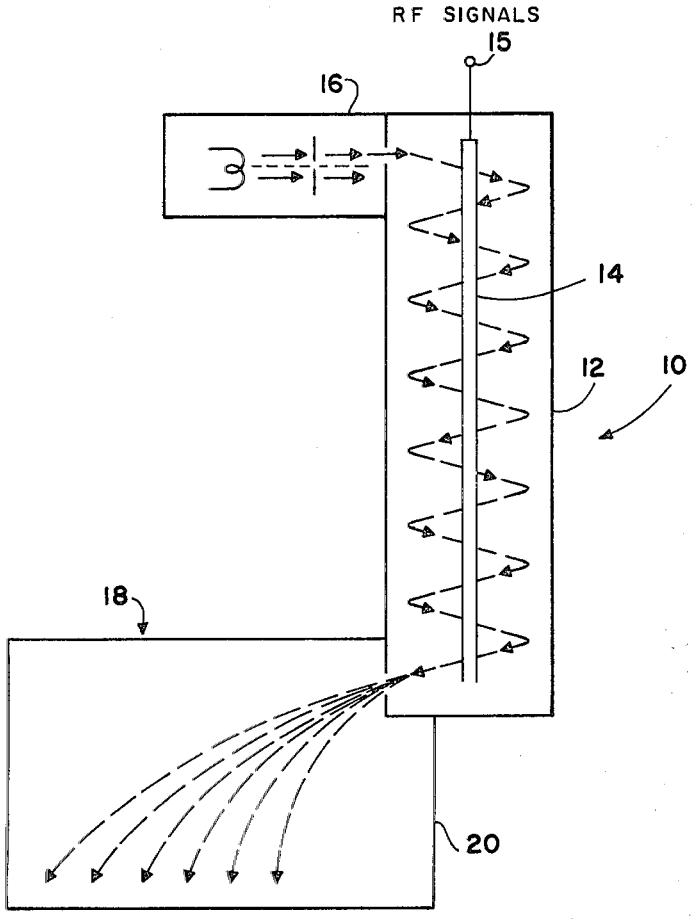
FIG. 1 is a simplified schematic diagram of self-optimizing detection and panoramic display apparatus embodying the inventive concept disclosed herein.

FIG. 1 is a simplified illustration of a self-optimizing and panoramic display device embodying the inventive concept to be disclosed herein. The essence of the device comprises a special purpose cathode ray tube (CRT) 10. The CRT includes a cylindrical drift tube 12. Disposed in a spaced and parallel manner with respect to each other, symmetrically within the tube 12 are two signal electrodes 14. Incoming received RF signals are fed to the electrodes at input terminal 15. An electron gun 16 is provided at the input of the CRT 10 and a display tube 18 is provided at the output of the CRT. The display tube 18 includes a panoramic display face 20.

Figure 2:
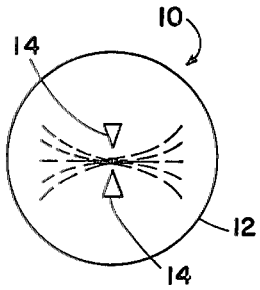
FIG. 2 is a cross-sectional view of the detection apparatus of FIG. 1 along the plane X-X′ which is shown as being perpendicular to the electrodes 14 of FIG. 1.

The novel device of FIG. 1 comprises a combined detector and display unit that can detect any RF signal within a wide bandwidth by means of the interaction existing between the RF signal and an electron beam that is produced in the CRT 10. In operation the electron gun 16 produces a beam of electrons that has a "white" velocity spectrum and that is ejected into the drift tube 12. The velocity spectrum is produced in a conventional manner by amplitude-modulating the accelerating anode of the CRT 10 with, for example, a sawtooth voltage. The walls of the cylindrical drift tube 12 are maintained at a negative potential whereby the walls repel the electrons. The signal electrodes 14 on the other hand, are maintained at a positive potential whereby they attract the electrons. The signal electrodes thus essentially comprise a conventional electron lens that guides the electron beam through the central gap between the electrodes. The electrons in the beam travel in a zig-zag manner in accordance with conventional electric field theory along the length of the drift tube many times as indicated by the dash lines in FIG. 1 and in FIG. 2 before they finally emerge into the display tube 18.

The RF signals to be detected and displayed are applied between the top and bottom electrodes 14 of the drift tube. If the voltage of one RF signal accelerates an electron in an upward direction when it first crosses between the electrodes and if the radial electric field in the drift tube constrains the electron to move along the radius of a true section once it leaves the central electrode gap, then the electron will be moving in a downward direction when it next approaches the central electrode gap.

If the time (i.e., period) that the electron requires between successive crossings of the central gap is substantially equal to the period of two and one-half cycles of the RF signal then the second time that the electron crosses the gap the voltage of the RF signal will accelerate it in a downward direction. Thus the net effects of the RF signal voltage on the electron are summed or integrated over a sequence of electron crossings. If RF signals of many frequencies within, for example, half an octave, are present, only one signal frequency will interact coherently to produce a maximum integrated effect on electrons that entered the drift tube with a single value of velocity. Consequently for the device to operate with a wide range of signal frequencies the electron gum 16 must provide an electron beam containing electrons with a wide range of velocity, i.e., a white velocity spectrum.

In the display tube 18 the electrons are accelerated towards the display face 20. As FIG. 1 clearly illustrates each electron strikes the face of the display tube at a distance across the face that is dependent upon the initial velocity of each electron. Thus there is a one-to-one relationship existing between the velocity of an electron, the distance across the display face at which it makes its mark, and the frequency of the signal with which it interacts coherently.

This relationship governs the displacement-against-frequency characteristic of the panoramic display. The electron vertical velocity which is caused by integration of signal voltage effects gives the display its displacement-against-signal-voltage characteristic.

If the signal voltage is applied with the same amplitude and phase to the entire length of the signal central electrodes then electron displacements on the display face will show an integration of signal voltage over the period of the life of the electron in the drift tube. However, signal amplitude can be tapered along the length of the electrodes whereby the integrated effect of the signal on an electron only grows at a rate proportional to the square root of the number of interactions. This form of growth of integrated voltage with respect to time of integration is typical of a system of power integration. The system thus exhibits an effective or simulated power integration characteristic.

Different parts of each electron beam interact with different phases of the RF signal to be detected and displayed. The electron beam thus effectively represents a complete family of zero-beat detectors that can detect all the phases of each RF signal. Consequently the output electron beam has a spread between positive and negative limits representing detection of all possible phases of each RF signal.

The signal electrodes can be designed so that the signal creates its largest effect on the electrons in the region near the electron output from the drift tube whereby in the $m^{th}$-before-last-interaction, the electron beam experiences an effect proportional to $\left(\sqrt{m} - \sqrt{m - 1m -}\right)$.

This characteristic determines the nature of the integration of signal effect with time; consequently the system behavior may be compared to a family of zero-beat detectors, each of which is sampled at a rate of one per RF cycle and the samples are weighted according to an $(\sqrt{m} - \sqrt{m\text{-}1})$ law and then summed. Thus integration of the electron beam interaction is substantially equivalent to a low-pass filter following the zero-beat detector.

The electron beam produced by the electron gun or source 16 has a "white" velocity spectrum so that the beam contains a "white" spectrum of electron zig-zag periods. The novel device is thus able to detect any signal with an RF period within the range of electron zig-zag periods in the electron beam. In a typical design the novel device can detect RF signals between approximately 2.7 GHz and 3.7 GHz.

The behavior of the novel device described herein will now be described with respect to signals of different bandwidths where the measure of bandwidth (an inverse measure) will be taken as the maximum duration of a constant amplitude single frequency component of a signal. Obviously the longer the duration the longer will be the integrated effect of the component on the electron beam.

In fact, the effect will increase as the quantity $\sqrt{n}$ where $n$ is the number of interactions in each integration. Thus the amplitude of the panoramic display will increase as the $\sqrt{n}$ which is proportional to $1/\sqrt{B}$ where B is the signal bandwidth. The amplitude of the display thus clearly shows that the signal-to-noise ratio increases in direct proportion to the quantity $1/\sqrt{B}$. This is exactly the signal-to-noise behavior that can be achieved by the use of optimum receivers where the bandwidth and hence the noise power decreases as B decreases.

The behavior of the device with respect to white noise will now be described. An optimum performance condition is realized with the present invention when the novel device integration time is matched exactly to the duration of signal components. The device therefore can provide a signal-to-noise performance equal to that of other optimum bandwidth receivers. As the integration time of the device increases, however, there is very little change in noise output amplitude. This is so because each point on the display responds to a narrower bandwidth of noise and hence to a smaller noise power.

This increase in selectivity almost exactly compensates on white noise for the increase in response due to a longer integration. Thus the devise produces a signal-to-noise performance substantially equal to optimum performance even when its time constant (integration time) are not matched exactly to the incoming signals.

The electron source or gun 16 modulates the electron beam velocity with respect to time. Due to random velocity components, the electrons mix in the drift tube and the electron beam thus has the desired "white" velocity spectrum long before the exit from the output of the drift tube. The signal electrodes in the drift tube comprise an electron lens in effect to reduce the tendency of the electron beam to spread. Outside the region of the central electrodes the drift tube 14 has a circularly symmetric, retarding electric field that tends to return electrons to the center of the tube despite the velocity given to them by signal interactions.

Thus it can be seen that a new and novel self-optimizing apparatus for detecting and panoramically displaying any signal within a wide bandwidth has been disclosed. The device can be used to advantage to search for previously unknown signals. The device, in effect, comprises in a single structure, a plurality of detectors such that at least one detector is suitable for optimum detection of any signal within the preselected bandwidth. This novel feature is achieved by using an electron beam with a white velocity spectrum and causing this beam to zig-zag between two electrodes carrying the RF signals whereby the electrons have multiple interactions with the RF signals. A novel form of integration is also utilized in the present device such that the system is optimized for any signal even though the integration time does not exactly match the signal duration. This feature is achieved by weighting the signal voltage by different amounts at different points along the drift tube to result in a ( $\sqrt{m} - \sqrt{m-1}$ ) integration law.

Obviously many modifications and variations of the present invention are possible in the light of the above teachings. It is therefore to be understood that within the scope of the appended claims the invention may be practiced otherwise than as specifically described. For example, a solid state equivalent of the drift tube could be used having solid state shift registers and gates that are compatible with LSI techniques. The filtering technique could be implemented by a digital computer operating on sample data from a conventional detector. This would produce the desired result of a system response optimized to signals independently of the integrating time employed.

What is claimed is:

1. Self-optimizing RF signal detection and display apparatus comprising:

a cathode ray tube having a drift tube;

a pair of elongated signal electrodes, said electrodes being disposed in a spaced and parallel manner with respect to each other symmetrically within said drift tube and further being at a positive potential with respect to said drift tube;

input terminal means for coupling an incoming RF signal to said electrodes;

electron source means for producing an electron beam traveling within said drift tube and having a selectively predetermined range of electron velocities;

means for guiding said electron beam through said drift tube and between said signal electrodes in a substantially zig-zag manner, whereby the electrons in said electron beam interact with said incoming RF signal to thereby produce a deflection of said electron beam, said deflection being proportional to the frequency of said incoming RF signal and to the velocity of the electrons that interact with said signal, and, having a maximum value when the cyclic period of said electron beam is substantially equal to the cyclic period of said signal, panoramic display means connected to the output of said drift tube and being adapted to display said electron beam after it is deflected.

* * * * *